US008845280B2

(12) United States Patent
Diamond et al.

(10) Patent No.: US 8,845,280 B2
(45) Date of Patent: Sep. 30, 2014

(54) BLADES

(75) Inventors: Stephen C. Diamond, Derby (GB); Caner H. Helvaci, Derby (GB); Roderick M. Townes, Derby (GB); Ian Tibbott, Litchfield (GB); Dougal R. Jackson, Stanton-By-Bridge (GB)

(73) Assignee: Rolls-Royce PLC, London (GB)

( * ) Notice: Subject to any disclaimer, the term of this patent is extended or adjusted under 35 U.S.C. 154(b) by 777 days.

(21) Appl. No.: 13/069,011

(22) Filed: Mar. 22, 2011

(65) Prior Publication Data

US 2011/0255986 A1 Oct. 20, 2011

(30) Foreign Application Priority Data

Apr. 19, 2010 (GB) ..... 1006450.9

(51) Int. Cl.
*F01D 11/08* (2006.01)
*F01D 5/20* (2006.01)

(52) U.S. Cl.
CPC ..... *F01D 5/20* (2013.01)
USPC ..... 415/168.2; 415/173.1

(58) Field of Classification Search
USPC ..... 415/168.2, 173.1, 173.3, 173.6; 416/194, 195, 196 R, 189
See application file for complete search history.

(56) References Cited

U.S. PATENT DOCUMENTS 3,635,585 A * 1/1972 Metzler, Jr. ..... 416/96 R
5,503,527 A * 4/1996 Lee et al. ..... 416/91
5,564,902 A * 10/1996 Tomita ..... 416/97 R
5,733,102 A * 3/1998 Lee et al. ..... 416/97 R
6,059,530 A * 5/2000 Lee ..... 416/97 R
6,142,739 A 11/2000 Harvey
7,494,319 B1 * 2/2009 Liang ..... 416/92
7,513,743 B2 * 4/2009 Liang ..... 416/92
7,632,062 B2 * 12/2009 Harvey et al. ..... 415/115
2004/0146401 A1 * 7/2004 Chlus et al. ..... 416/97 R
2005/0031449 A1 * 2/2005 Cleveland et al. ..... 416/97 R
2005/0232771 A1 * 10/2005 Harvey et al. ..... 416/97 R
2009/0123292 A1 * 5/2009 Gu et al. ..... 416/97 R
2009/0162200 A1 * 6/2009 Tibbott et al. ..... 416/91

FOREIGN PATENT DOCUMENTS

DE 1 937 395 A1 2/1971
EP 1 541 806 A2 6/2005
EP 2 161 412 A2 3/2010
SU 779 591 A1 11/1980

OTHER PUBLICATIONS

European Search Report issued in Application No. 11 15 9161; Dated Apr. 27, 2011.

(Continued)

*Primary Examiner* — Edward Look
*Assistant Examiner* — Aaron R Eastman
(74) *Attorney, Agent, or Firm* — Oliff PLC

(57) ABSTRACT

A turbine blade for a gas turbine engine has an aerofoil portion extending from a root to a tip. The tip carries winglets. A gutter extends across the tip to entrain gas leaking around the tip (over tip leakage). The aerofoil portion has a mean camber line and the gutter has a center line. In the examples described, the conditions that (a) the mean camber line and the centre line coincide at the exit when viewed from the tip towards the root, and (b) the mean camber line and the center line are parallel at the exit when viewed as aforesaid, are not both fulfilled.

13 Claims, 6 Drawing Sheets

(56) References Cited

OTHER PUBLICATIONS

Harvey et al., "A Computational Study of a Novel Turbine Rotor Partial Shroud," *Journal of Turbomachinery*, 2001, pp. 534-543, vol. 123.

Harvey et al., "An Investigation Into a Novel Turbine Rotor Winglet. Part 1: Design and Model Rig Test Results," *ASME Turbo Expo 2006: Power for Land, Sea and Air*, 2006, GT2006-90456, Barcelona, Spain.

Willer et al., "An Investigation Into a Novel Turbine Rotor Winglet. Part 2: Numerical Simulation and Experimental Results," *ASME Turbo Expo 2006: Power for Land, Sea and Air*, 2006, GT2006-90459, Barcelona, Spain.

Search Report issued in corresponding British Application No. 1006450.9 dated Jul. 19, 2010.

* cited by examiner

Fig.4a
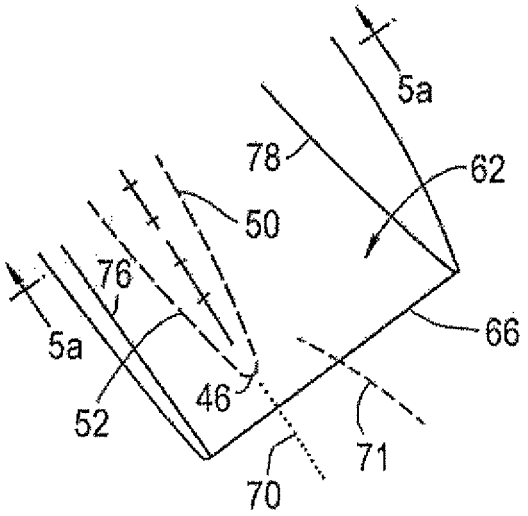
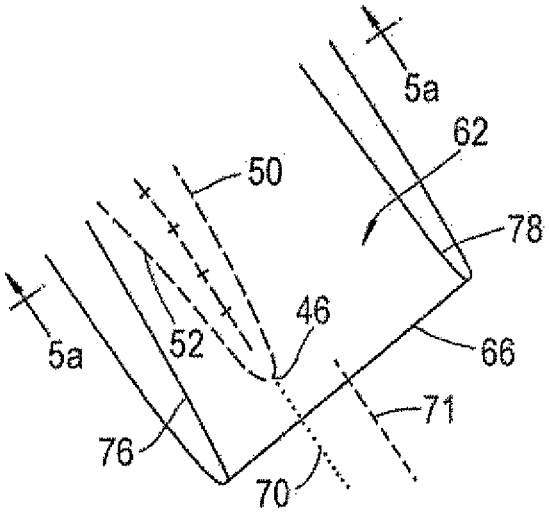
Fig.4b
Fig.4c
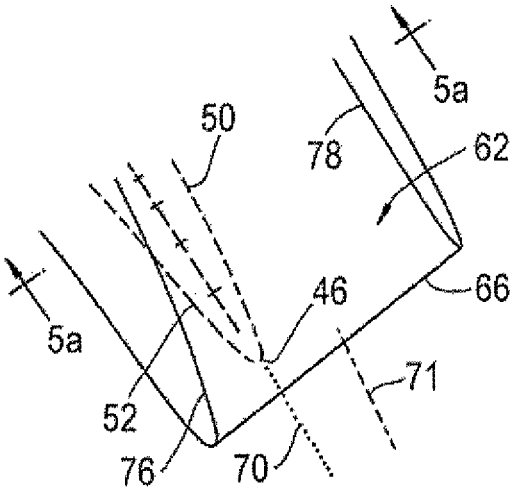

BLADES

The present invention relates to rotor blades.

Rotor blades are used in gas turbine engines to interact with combustion gases to convert kinetic energy of the combustion gases into rotation of the rotor. The efficiency of the engine is affected by the manner in which the combustion gases flow around the rotor blades.

Examples of the present invention provide a rotor blade having an aerofoil portion with a leading edge, a trailing edge, a tip and a root, there being at least one gutter extending across the tip to an exit in the region of the trailing edge, the aerofoil portion having a mean camber line and the gutter having a centre line when viewed from the tip towards the root, and the blade being configured to the conditions that (a) the mean camber line and centre line coincide at the exit when viewed as aforesaid, and (b) the mean camber line and the centre line are parallel at the exit when viewed as aforesaid, are not both fulfilled.

Additional features of examples of the invention are set out in the attached claims, to which reference should now be made.

Examples of the present invention also provide a gas turbine engine characterised by comprising at least one rotor blade according to this aspect of the invention.

Examples of the present invention will now be described in more detail, with reference to the accompanying drawings, in which.

Figure 3:
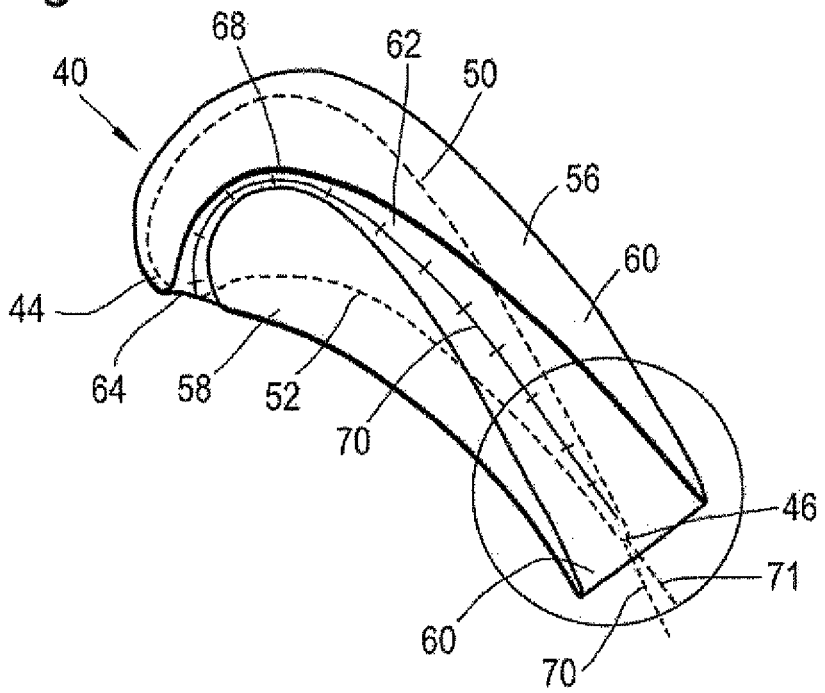
FIG. 3 is an end view of the blade of FIG. 2.
Figure 4D:
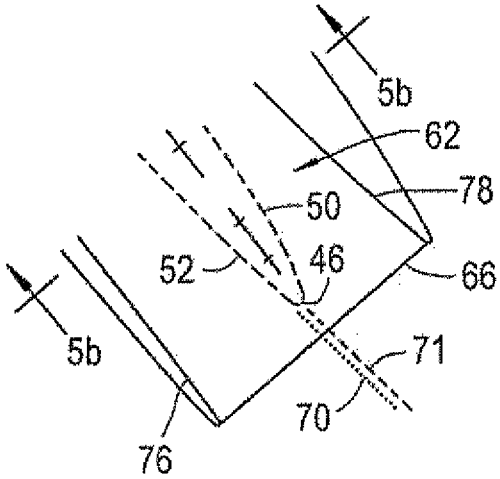
Figure 4E:
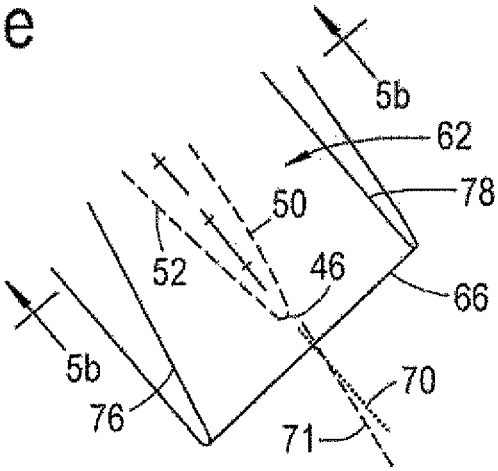
Figure 4F:
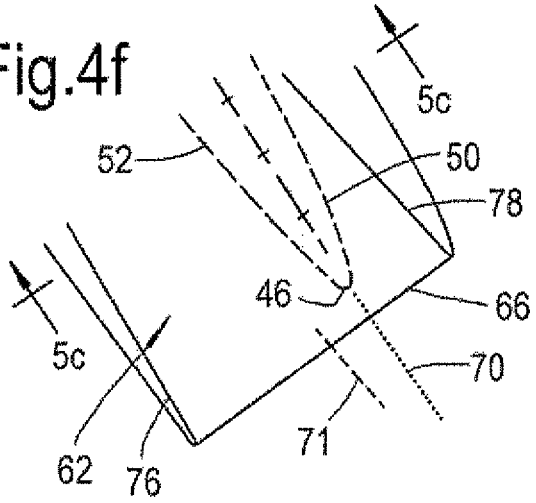
Figure 4G:
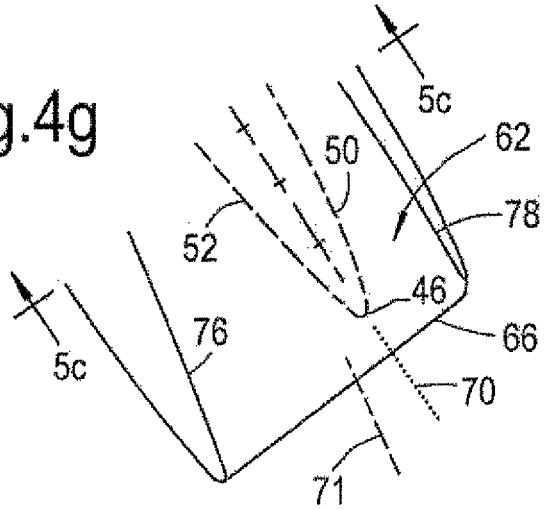
Figure 4H:
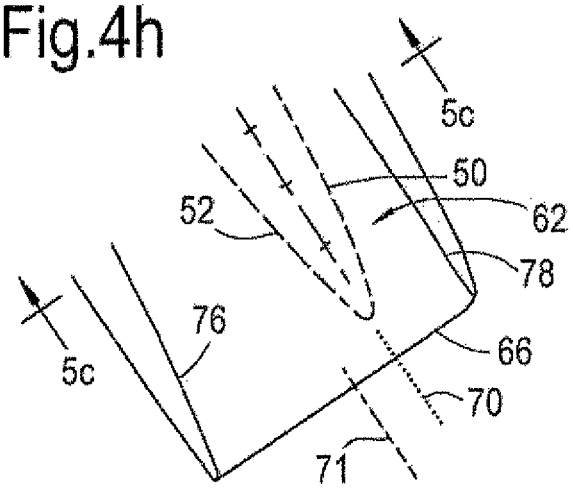
Figure 5A:
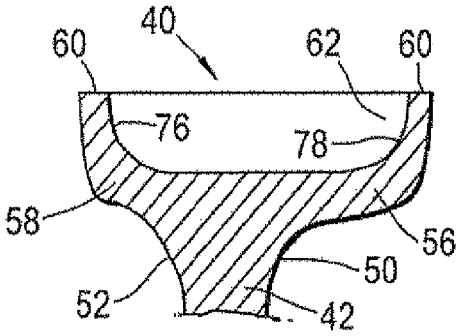
Figure 6:
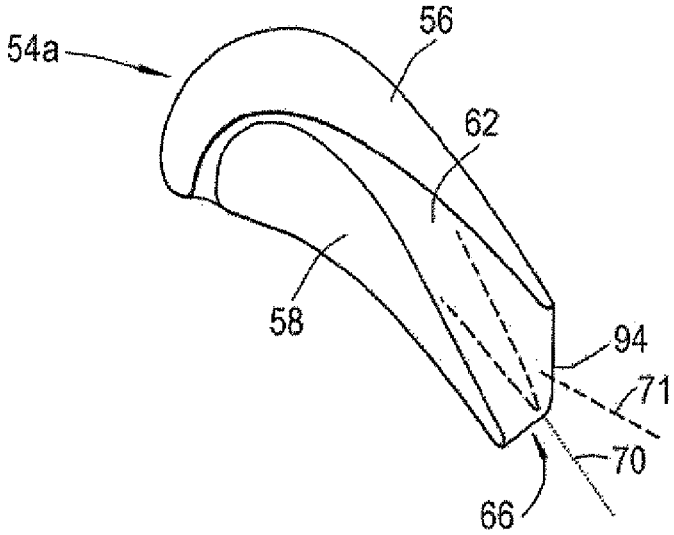

FIGS. 4*a* to 4*h* show enlarged partial views of the ringed part of FIG. 3 in various examples to be described;

FIGS. 5*a, b* and *c* show sections through the lines 5*a*-5*a*, 5*b*-5*b* and 5*c*-5*c* in FIG. 4; and FIG. 6 is an end view of an alternative example of blade.

Figure 1:
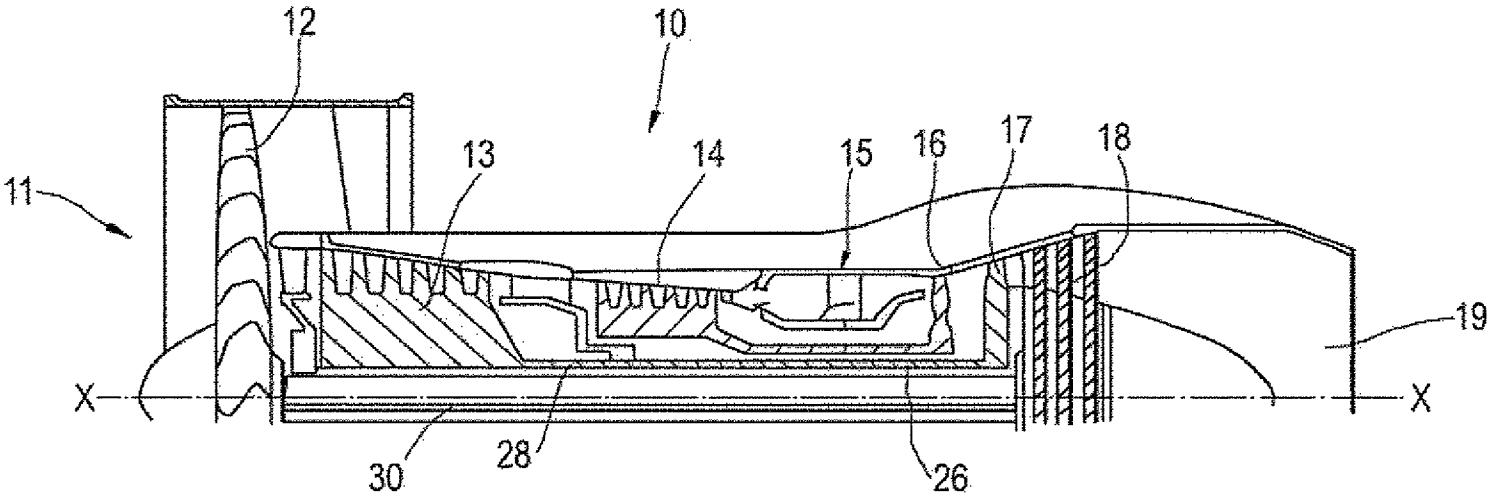
FIG. 1 is a simplified partial section along the rotation axis of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

The efficiency of the engine is affected by the manner in which the combustion gases flow around the rotor blades, as noted above. For example, a recognized problem exists, arising from leakage of combustion gases between the rotating tip of the turbine blades and the stationary casing which surrounds them. This leakage is sometimes called "over tip leakage". Previous proposals for addressing losses arising from over tip leakage have included the provision of a rotating shroud carried by the rotor blade tips and carrying fins which act as labyrinth seals.

The following examples seek to address problems associated with over tip leakage.

Figure 2:
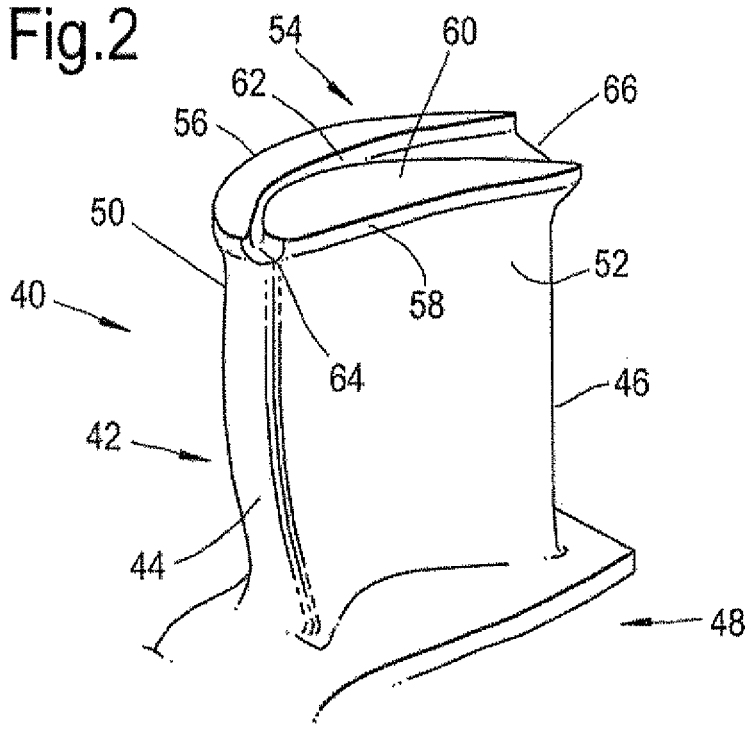
FIG. 2 is a perspective view of a turbine blade for use in an engine of the type shown in FIG. 1.

FIG. 2 illustrates a single rotor blade 40 for use in one of the turbines 16, 17, 18 of the gas turbine engine 10. The blade 40 has an aerofoil portion 42 which interacts with combustion gases passing through the turbine. The aerofoil portion 42 has a leading edge 44 and a trailing edge 46. A root 48, which may be shrouded, provides for mounting the blade 40 on a rotor disc (not shown) in conventional manner. The aerofoil portion 42 has a suction face 50 and a pressure face 52. The aerodynamic form of the portion 42 creates aerodynamic lift, which in turn creates rotation in the turbine, thus turning the turbine disc.

The blade 40 has a tip 54 which is at the radially outer end of the blade 40, when the turbine is rotating. The tip 54 carries winglets 56, 58 which project laterally from the blade 40, at the radially outer end of the suction face 50 and pressure face 52, respectively. The winglets provide an end face 60 to the blade 40.

A gutter 62 extends across the tip 54. That is, the gutter 62 is provided across the end face 60. The gutter 62 extends from a mouth 64 in the region of the leading edge 44, to an exit 66 in the region of the trailing edge 46. That is, when viewed from the tip 54 along the blade 40 toward the root 48, the leading edge 44 is within or close to the mouth 64 and the trailing edge 46 is within or close to the exit 66. This view is shown in FIG. 3, on which the shapes of the suction face 50 and pressure face 52 are indicated in broken lines, so that the positions of the leading edge 44 and trailing edge 46 relative to the mouth 64 and exit 66 can be seen. The lateral overhang of the winglets 56, 58 can also be seen in FIG. 3.

The aerofoil portion 42 has a mean camber line 70 (FIG. 3). The mean camber line 70 is the line of points which lie equidistant from the suction face 50 and the pressure face 52, at any position along the aerofoil portion 42, between the leading edge 44 and the trailing edge 46. Accordingly, the mean camber line 70 extends from the leading edge 44 to the trailing edge 46. The gutter 62 has a centre line 71 when viewed from the tip 54 towards the root 48. The centre line 71 is the line of points which lie halfway across the gutter 62, at any position along the gutter 62. That is, each point lies halfway between the boundaries 76, 78 which define the width of the gutter 62. Accordingly, the centre line 71 extends along the whole length of the gutter 62.

Various orientations and relative orientations of the mean camber line 70 and the centre line 71 are possible. The mean camber line 70 and the centre line 71 of the gutter 62 may coincide at the exit 66 when viewed from the tip 54 towards the root 48, or the centre line of the gutter 62 may be offset relative to the mean camber line 70 of the aerofoil portion 42. The mean camber line 70 of the aerofoil portion 42 and the centre line 71 of the gutter 62 may be parallel at the exit 66 when viewed from the tip 54 towards the root 48, or the centre line 71 of the gutter 62 may be differently directed to the mean camber line 70 of the aerofoil portion 42, so that the two are not parallel. Various examples will be described, and in each of these, the conditions that (a) the mean camber line 70 and the centre line 71 coincide at the exit when viewed as aforesaid, and (b) the mean camber line 70 and the centre line 71 are parallel at the exit 66 when viewed as aforesaid, are not both fulfilled. One of these conditions may be fulfilled, or neither, but not both.

FIG. 3 shows the mean camber line 70 of the aerofoil portion 42. FIG. 3 also shows the centre line 71 of the gutter 62. In this example, the mouth 64 is aligned with the leading edge 44. Thus, the centre line 71 of the gutter 62, at the mouth 64, is centred at the mean camber line 70. This also places the mouth 64 substantially at the stagnation point of the airflow at the leading edge 44.

Along much of the length of the gutter 62, the centre line 71 of the gutter 62 remains substantially aligned with the mean camber line 70, as can be seen in FIG. 3. That is, the boundaries 76, 78 of the gutter 62 lie equidistant to each side of the mean camber line 70, along much of the length of the gutter 62.

Figure 5B:
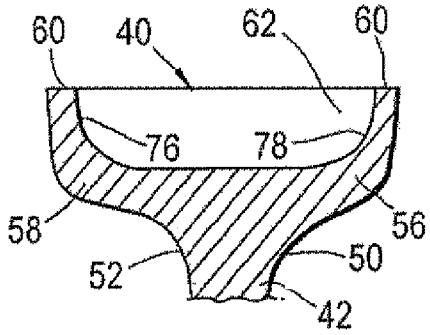
Figure 5C:
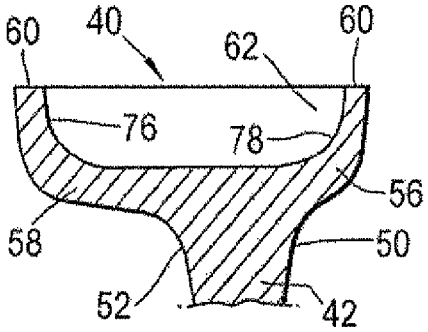

At the exit 66, various alignments are envisaged, illustrated in FIG. 4*a* to *h*. In each of these drawings, attention is drawn to the position and direction of the mean camber line 70, and to the position and direction of the centre line 71 of the gutter 62. FIGS. 5*a* to 5*c* are sections to assist in understanding the relative positions of the mean camber line 70 and the centre line 71.

In FIG. 4*a*, the mean camber line 70 and the centre line 71 do not coincide at the exit when viewed from the tip 54 towards the root 48. The centre line 71 of the gutter 62 is offset from the mean camber line 70 of the aerofoil portion, in the direction of the suction face 50 of the aerofoil portion 42. This can be seen most clearly in FIG. 5*a*. Thus, condition (a) is not fulfilled. Secondly, the mean camber line 70 and the centre line 71 are not parallel at the exit 66 when viewed from the tip 54 towards the root 48. The centre line 71 of the gutter 62 is directed more towards the suction face side of the mean camber line 70. Thus, condition (b) is not fulfilled. Thus, the two conditions are not both fulfilled.

In FIG. 4*b*, the mean camber line 70 and the centre line 71 do not coincide at the exit when viewed from the tip 54 towards the root 48, as can be seen in FIG. 5*b*. The centre line 71 of the gutter 62 is offset from the centre line 70 of the aerofoil portion, in the direction of the suction face 50. Thus, condition (a) is not fulfilled. However, the mean camber line 70 and the centre line 71 are parallel at the exit 66 when viewed from the tip 54 towards the root 48. Thus, condition (b) is fulfilled, but the two conditions are not both fulfilled.

In FIG. 4*c*, the mean camber line 70 and the centre line 71 do not coincide at the exit when viewed from the tip 54 towards the root 48, as can be seen in FIG. 5*c*. The centre line 71 of the gutter 62 is offset from the centre line 70 of the aerofoil portion, in the direction of the suction face 50. Thus, condition (a) is not fulfilled. Secondly, the mean camber line 70 and the centre line 71 are not parallel at the exit 66 when viewed from the tip 54 towards the root 48. The centre line 71 of the gutter 62 is directed more towards the pressure face side of the mean camber line 70. Thus, condition (b) is not fulfilled. Thus, neither condition is fulfilled.

In FIG. 4*d*, the mean camber line 70 and the centre line 71 do coincide at the exit when viewed from the tip 54 towards the root 48. Thus, condition (a) is fulfilled. However, the mean camber line 70 and the centre line 71 are not parallel at the exit 66 when viewed from the tip 54 towards the root 48. The centre line 71 of the gutter 62 is directed more towards the suction face side of the mean camber line 70. Thus, condition (b) is not fulfilled. Thus, the two conditions are not both fulfilled.

In FIG. 4*e*, the mean camber line 70 and the centre line 71 do coincide at the exit when viewed from the tip 54 towards the root 48. Thus, condition (a) is not fulfilled. However, the mean camber line 70 and the centre line 71 are not parallel at the exit 66 when viewed from the tip 54 towards the root 48. The centre line 71 of the gutter 62 is directed more towards the suction face side of the mean camber line 70. Thus, condition (b) is not fulfilled. Thus, the two conditions are not both fulfilled.

In FIG. 4*f*, the mean camber line 70 and the centre line 71 do not coincide at the exit when viewed from the tip 54 towards the root 48. The centre line 71 of the gutter 72 is offset from the mean camber line 70, in the direction of the pressure face 52 of the aerofoil portion 42. Thus, condition (a) is not fulfilled. Secondly, the mean camber line 70 and the centre line 71 are not parallel at the exit 66 when viewed from the tip 54 towards the root 48. The centre line 71 of the gutter 62 is directed more towards the suction face side of the mean camber line 70. Thus, condition (b) is not fulfilled. Thus, neither of the two conditions is fulfilled.

In FIG. 4*h*, the mean camber line 70 and the centre line 71 do not coincide at the exit when viewed from the tip 54 towards the root 48. The centre line 71 of the gutter 72 is offset from the mean camber line 70, in the direction of the pressure face 52 of the aerofoil portion 42. Thus, condition (a) is not fulfilled. The mean camber line 70 and the centre line 71 are parallel at the exit 66 when viewed from the tip 54 towards the root 48. Thus, condition (b) is fulfilled. However, the two conditions are not both fulfilled.

In FIG. 4*g*, the mean camber line 70 and the centre line 71 do not coincide at the exit when viewed from the tip 54 towards the root 48. The centre line 71 of the gutter 72 is offset from the mean camber line 70, in the direction of the pressure face 52 of the aerofoil portion 42. Thus, condition (a) is not fulfilled. Secondly, the mean camber line 70 and the centre line 71 are not parallel at the exit 66 when viewed from the tip 54 towards the root 48. The centre line 71. of the gutter 62 is directed more towards the pressure face side of the mean camber line 70. Thus, condition (b) is not fulfilled. Thus, neither of the two conditions is fulfilled.

Thus, it can be seen from these examples that the applicability of condition (a) depends on the spacing of the boundaries 76, 78 of the gutter 62, from the mean camber line 70. This may, in turn, be affected by the degree of overhang of each of the winglets 56, 58. The applicability of condition (b) depends on the direction of the boundaries 76, 78 at the exit 66, relative to the direction of the mean camber line 70.

In use, a flow of combustion gas is established across the aerofoil portion 42 but some tendency to over tip leakage can be expected, as noted above, by virtue of the pressure differences at the faces 50, 52. Some over tip leakage flow will be entrained by the gutter 62 to be redirected along the gutter 62, to the exit 66. As this entrained gas leaves the exit 66, it returns to the main combustion gas flow, in the vicinity of the trailing edge 46. Condition (a) relates to the position of the gutter exit 66 relative to the trailing edge 46 and thus affects the position at which combustion gas leaves the exit 66 to return to the main combustion gas flow. Condition (b) relates to the direction of the gutter exit 66 relative to the trailing edge 46 and thus affects the angle at which combustion gas returns to the main combustion gas flow. Consequently, choosing the position and direction of the gutter exit 66 provides control over mixing losses associated with the return of gases from the gutter to the main flow.

FIG. 6 illustrates a tip 54*a* which generally corresponds closely with the tip 54 described above. The tip 54*a* differs from the tip 54 in that there is a cut-away 94 in the region of the exit 66. That is, the winglet 56 is cut back, thus also shortening the boundary 78. This reduces the mass of the winglet 56 and the extent of the overhang of the winglet 56.

This is expected to result in reduced bending loads or other reduced stresses in the region of the trailing edge 46. However, the removal of the cut-away 94 will also affect gas flow in the region of the trailing edge 46 and should therefore be designed to avoid reintroducing losses of the type discussed above.

The formation of the cutaway 94 results in the centre line 71 being closer to the suction face 50 than the mean camber line 70 is, and also in the centre line 71 being directed more towards the suction face 50 than the mean camber line 70 is.

Many alternatives and variations can be envisaged for the examples described above. Many different shapes of gutter could be envisaged, according to the manner in which the effects of the described examples are to be achieved. Multiple gutters could be used.

The turbine blades described above can be used in aero engines, marine engines or industrial engines, or for power generation.

The invention claimed is:

1. A rotor blade for use in a turbine engine, the rotor blade comprising:

an aerofoil portion including:

a leading edge, a trailing edge, a tip having winglets configured to project laterally outward at a radially outer end of: (1) a suction face of the aerofoil portion, and (2) a pressure face of the aerofoil portion, a root, and at least one gutter extending across the tip to an exit in the region of the trailing edge, the aerofoil portion having a mean camber line, and the gutter having a centre line when viewed from the tip towards the root, and the rotor blade being configured such that: (i) the centre line is offset from the mean camber line in the direction of the suction face of the aerofoil portion, (ii) the mean camber line and the centre line coincide at the exit when viewed from the tip towards the root, and (iii) the mean camber line and the centre line arc not parallel at the exit when viewed from the tip towards the root.

2. The rotor blade according to claim 1, wherein the centre line of the gutter is directed to the pressure face side of the mean camber line, when viewed as aforesaid.

3. The rotor blade according to claim 1, wherein the centre line of the gutter is directed to the suction face side of the mean camber line, when viewed as aforesaid.

4. The rotor blade according to claim 1, wherein the gutter is partially cut away at the exit, above the suction surface of the aerofoil portion.

5. The rotor blade according to claim 1, wherein the blade extends across the tip from a mouth, the mouth being located substantially at the stagnation point of the airflow at the leading edge of the aerofoil portion.

6. A gas turbine engine comprising at least one rotor blade according to claim 1.

7. A rotor blade for use in a turbine engine, the rotor blade comprising:

an aerofoil portion including:

a leading edge, a trailing edge, a tip, a root, and at least one gutter extending across the tip to an exit in the region of the trailing edge, the at least one gutter being configured to decrease in width from an opening at the leading edge to a throat region and to increase in width from the throat region to the trailing edge, the aerofoil portion having a mean camber line, and the gutter having a centre line when viewed from the tip towards the root, and the rotor blade being configured such that the following two conditions: (a) the mean camber line and the centre line coincide at the exit when viewed from the tip towards the root, and (b) the mean camber line and the centre line are parallel at the exit when viewed from the tip towards the root, are not both fulfilled.

8. A rotor blade for use in a turbine engine, the rotor blade comprising:

an aerofoil portion including:

a leading edge, a trailing edge, a tip having winglets configured to project laterally outward at: a radially outer end of (1) a suction face of the aerofoil portion, and (2) a pressure face of the aerofoil portion, a root, and at least one gutter extending across the tip to an exit in the region of the trailing edge, the aerofoil portion having a mean camber line, and the gutter having a centre line when viewed from the tip towards the root, and the rotor blade being configured such that: (i) the centre line is offset from the mean camber line in the direction of the suction face of the aerofoil portion, (ii) the mean camber line and the centre line do not coincide at the exit when viewed from the tip towards the root, and (iii) the mean camber line and the centre line are not parallel at the exit when viewed from the tip towards the root.

9. The rotor blade according to claim 8, wherein the centre line of the gutter is directed to the pressure face side of the mean camber line, when viewed as aforesaid.

10. The rotor blade according to claim 8, wherein the centre line of the gutter is directed to the suction face side of the mean camber line, when viewed as aforesaid.

11. The rotor blade according to claim 8, wherein the gutter is partially cut away at the exit, above the suction surface of the aerofoil portion.

12. The rotor blade according to claim 8, wherein the blade extends across the tip from a mouth, the mouth being located substantially at the stagnation point of the airflow at the leading edge of the aerofoil portion.

13. A gas turbine engine comprising at least one rotor blade according to claim 8.

* * * * *